US006805201B2

(12) United States Patent
Nish et al.

(10) Patent No.: US 6,805,201 B2
(45) Date of Patent: Oct. 19, 2004

(54) INTERNAL BEAM BUOYANCY SYSTEM FOR OFFSHORE PLATFORMS

(75) Inventors: Randall W. Nish, Provo, UT (US); Daniel C. Kennedy, II, Salt Lake City, UT (US); Randy A. Jones, Park City, UT (US)

(73) Assignee: EDO Corporation, Fiber Science Division, Salt Lake City, UT (US)

( * ) Notice: Subject to any disclaimer, the term of this patent is extended or adjusted under 35 U.S.C. 154(b) by 75 days.

(21) Appl. No.: 10/349,476

(22) Filed: Jan. 21, 2003

(65) Prior Publication Data

US 2003/0150618 A1 Aug. 14, 2003

Related U.S. Application Data

(63) Continuation-in-part of application No. 10/061,086, filed on Jan. 31, 2002, now abandoned.

(51) Int. Cl.[7] ..... E21B 29/12

(52) U.S. Cl. ..... 166/367; 166/368; 166/350; 405/224.3

(58) Field of Search ..... 166/367, 368, 166/350; 405/223.1, 224, 224.1, 224.2, 224.3, 224.4; 114/264

(56) References Cited

U.S. PATENT DOCUMENTS

| | | | | |
|---|---|---|---|---|
| 3,470,838 A | | 10/1969 | Daniell | |
| 3,858,401 A | * | 1/1975 | Watkins | 405/224.2 |
| 3,933,108 A | | 1/1976 | Baugh | |
| 3,952,526 A | | 4/1976 | Watkins et al. | |
| 3,957,112 A | | 5/1976 | Knibbe et al. | |
| RE28,966 E | | 9/1976 | Blockwick | |
| 3,992,889 A | | 11/1976 | Watkins et al. | |
| 4,078,605 A | | 3/1978 | Jones | |
| 4,099,560 A | | 7/1978 | Fischer et al. | |

(List continued on next page.)

FOREIGN PATENT DOCUMENTS

| | | |
|---|---|---|
| GB | 2069450 A | 8/1981 |
| GB | 2156407 A | 10/1985 |

*Primary Examiner*—Robert E. Pezzuto
*Assistant Examiner*—Thomas A Beach
(74) *Attorney, Agent, or Firm*—Thorpe North & Western

(57) ABSTRACT

A buoyancy system to buoy a riser of an offshore oil platform includes buoyancy compartments coupled around an elongated internal beam. The internal beam can withstand loads between the oil platform and the buoyancy system, while the buoyancy compartments provide buoyancy. The internal beam includes an elongated stem, a plurality of webs extending radially outwardly from the stem, and a plurality of transverse flanges attached to the outer edges of the webs.

6 Claims, 10 Drawing Sheets

U.S. PATENT DOCUMENTS 4,102,142 A 7/1978 Lee
4,176,986 A * 12/1979 Taft et al. ..... 405/211
4,249,610 A * 2/1981 Loland ..... 166/360
4,256,417 A 3/1981 Bohannon
4,390,186 A 6/1983 McGee et al.
4,398,487 A 8/1983 Ortloff et al.
4,422,801 A * 12/1983 Hale et al. ..... 405/171
4,448,266 A 5/1984 Potts
4,470,722 A 9/1984 Gregory
4,474,129 A 10/1984 Watkins et al.
4,477,207 A * 10/1984 Johnson ..... 405/195.1
4,511,287 A 4/1985 Horton
4,596,531 A 6/1986 Schawann et al.
4,604,961 A 8/1986 Ortloff et al.
4,606,673 A 8/1986 Daniell
4,616,707 A 10/1986 Langner
4,630,970 A 12/1986 Gunderson et al.
4,634,314 A 1/1987 Pierce
4,646,840 A * 3/1987 Bartholomew et al. ..... 166/350
4,648,747 A 3/1987 Watkins et al.
4,652,022 A 3/1987 Nichols
4,702,321 A 10/1987 Horton
4,740,109 A 4/1988 Horton
4,768,455 A 9/1988 Maxson et al.
4,808,034 A 2/1989 Birch
4,821,804 A 4/1989 Pierce
4,934,871 A 6/1990 Kazokas, Jr.
5,044,828 A 9/1991 Berner, Jr. et al.
5,098,132 A 3/1992 Burton
5,330,294 A 7/1994 Guesnon
5,368,648 A 11/1994 Sekizuka
5,421,413 A 6/1995 Allen et al.
5,431,511 A 7/1995 Guy
5,439,060 A 8/1995 Huete et al.
5,439,321 A 8/1995 Hunter
5,447,392 A 9/1995 Marshall
5,542,783 A 8/1996 Pollack
5,558,467 A 9/1996 Horton
5,651,709 A 7/1997 Nandakumar et al.
5,706,897 A 1/1998 Horton, III
5,758,990 A 6/1998 Davies et al.
5,771,975 A 6/1998 Anderson et al.
5,823,131 A 10/1998 Boatman et al.
5,873,416 A 2/1999 Horton, III
5,881,815 A 3/1999 Horton, III
5,984,584 A 11/1999 McMillan et al.
6,000,422 A 12/1999 Shigemoto
6,004,074 A 12/1999 Shanks, II
6,067,922 A 5/2000 Denison et al.
6,092,483 A * 7/2000 Allen et al. ..... 114/264
6,155,748 A 12/2000 Allen et al.
6,161,620 A * 12/2000 Cox et al. ..... 166/367
6,164,348 A 12/2000 Rodwell et al.
6,179,524 B1 1/2001 Allen et al.
6,193,441 B1 2/2001 Fisher
6,213,045 B1 4/2001 Gaber
6,227,137 B1 5/2001 Allen et al.
6,347,912 B1 2/2002 Thomas
6,367,846 B1 4/2002 Aaron, III
6,375,391 B1 4/2002 B.o slashed.rseth et al.
6,406,223 B1 6/2002 Thomas
6,435,775 B1 8/2002 Nish et al.
6,439,810 B1 8/2002 Nish et al.
6,488,447 B1 12/2002 Nish et al.

* cited by examiner

INTERNAL BEAM BUOYANCY SYSTEM FOR OFFSHORE PLATFORMS

This application is a continuation-in-part application of U.S. patent application Ser. No. 10/061,086, filed Jan. 31, 2002.

BACKGROUND OF THE INVENTION

1. Field of the Invention

The present invention relates generally to buoyancy systems for offshore oil platforms. More particularly, the present invention relates to a buoyancy system with an internal beam.

2. Related Art

As the cost of oil increases and/or the supply of readily accessible oil reserves are depleted, less productive or more distant oil reserves are targeted, and oil producers are pushed to greater extremes to extract oil from less productive oil reserves, or to reach more distant oil reserves. Such distant oil reserves may be located below the oceans, and oil producers have developed offshore drilling platforms in an effort to extend their reach to these oil reserves. In addition, some oil reserves are located farther offshore, and thousands of feet below the surface of the oceans.

For example, vast oil reservoirs have recently been discovered in very deep waters around the world, principally in the Gulf of Mexico, Brazil and West Africa. Water depths for these discoveries range from 1500 to nearly 10,000 ft. Conventional offshore oil production methods using a fixed truss type platform are not suitable for these water depths. These platforms become dynamically active (flexible) in these water depths. Stiffening them to avoid excessive and damaging dynamic responses to wave forces is prohibitively expensive.

Deep-water oil and gas production has thus turned to new technologies based on floating production systems. These systems come in several forms, but all of them rely on buoyancy for support and some form of a mooring system for lateral restraint against the environmental forces of wind, waves and current.

These floating production systems (FPS) sometimes are used for drilling as well as production. They are also sometimes used for storing oil for offloading to a tanker. This is most common in Brazil and West Africa, but not in Gulf of Mexico as of yet. In the Gulf of Mexico, oil and gas are exported through pipelines to shore.

Certain floating oil platforms, known as spars or Deep Draft Caisson Vessels (DDCV) have been developed to reach these oil reserves. Steel tubes or pipes, known as risers, are suspended from these floating platforms, and extend the thousands of feet to reach the ocean floor, and the oil reserves beyond.

Typical risers are either vertical (or nearly vertical) pipes held up at the surface by tensioning devices (called Top Tensioned riser); or flexible pipes which are supported at the top and formed in a modified catenary shape to the sea bed; or steel pipe which is also supported at the top and configured in a catenary to the sea bed (Steel Catenary Risers—commonly known as SCRs).

The flexible and SCR type risers may in most cases be directly attached to the floating vessel. Their catenary shapes allow them to comply with the motions of the FPS caused by environmental forces. These motions can be as much as 10–20% of the water depth horizontally, and 10s of feet vertically, depending on the type of vessel, mooring and location.

Top Tensioned risers (TTRs) typically need to have higher tensions than the flexible risers, and the vertical motions of the vessel need to be isolated from the risers. TTRs have significant advantages for production over the other forms of risers, however, because they allow the wells to be drilled directly from the FPS, avoiding an expensive separate floating drilling rig. Also, wellhead control valves placed on board the FPS allow for the wells to be maintained from the FPS. Flexible and SCR type production risers require the wellhead control valves to be placed on the seabed where access is difficult and maintenance is expensive. These surface wellhead and subsurface wellhead systems are commonly referred to as "Dry tree" and "Wet Tree" types of production systems, respectively. Drilling risers must be of the TTR type to allow for drill pipe rotation within the riser. Export risers may be of either type.

TTR tensioning systems are a technical challenge, especially in very deep water where the required top tensions can be 1,000,000 lbs (1000 kips) or more. Some types of FPS vessels, e.g. ship shaped hulls, have extreme motions which are too large for TTRs. These types of vessels are only suitable for flexible risers. Other, low heave (vertical motion), FPS designs are suitable for TTRs. This includes Tension Leg Platforms (TLP), Semi-submersibles and Spars, all of which are in service today.

Of these, only the TLP and Spar platforms use TTR production fisers. Semisubmersibles use TTRs for drilling risers, but these must be disconnected in extreme weather. Production risers need to be designed to remain connected to the seabed in extreme events, typically the 100 year return period storm. Only very stable vessels, such as TLPs and Spars are suitable for this.

Early TTR designs employed on semi-submersibles and TLPs used active hydraulic tensioners to support the risers by keeping the tension relatively constant during wave motions. As tensions and stroke requirements grow, these active tensioners become prohibitively expensive. They also require large deck area, and the loads have to be carried by the FPS structure.

Spar type platforms recently used in the Gulf of Mexico use a passive means for tensioning the risers. These type platforms have a very deep draft with a central shaft, or centerwell, through which the risers pass. Types of spars include the Caisson Spar (cylindrical), the "Truss" spar and "Tube" spar. There may be as many as 40 production risers passing through a single centerwell.

It will be appreciated that these risers, formed of thousands of feet of steel pipe, have a substantial weight, which are supported by buoyant elements at the top of the risers. Steel buoyancy cans (i.e. air cans) have been developed which are coupled to the risers and disposed in the water to help buoy the risers, and eliminate the strain on the floating platform, or associated rigging. The steel buoyancy cans are typically cylindrical, and they are separated from each other by a rectangular grid structure referred to as riser"guides".

These guides are attached to the hull. As the hull moves, the tops of the risers are deflected horizontally with the guides. However, the risers are tied to the sea floor aid have a fixed length; hence as the vessel moves horizontally the risers slide up and down (from the viewpoint of a person on the vessel the risers are moving vertically within the guides).

A wellhead at the sea floor connects the well casing (below the sea floor) to the riser with a special Tieback Connector. The riser, typically 9–14" diameter pipe, passes from the tieback connector through thousands of feet of seawater to the bottom of the spar and into the centerwell. Inside the centerwell the riser passes through a stem pipe, or conduit, which goes through the center of the buoyancy cans. This stem extends above the buoyancy cans themselves and supports the platform to which the riser and the surface wellhead are attached. The stem can be centered in the buoyancy cans by "wagon wheel" type frame or spacer to hold or centralize the stem within the can.

Since the surface wellhead ("dry tree") move up and down relative to the vessel, flexible jumper lines connect the wellhead to a manifold which carries the oil to a processing facility to separate water, oil and gas from the well stream.

The underlying principal of the buoyancy cans is to remove a load-bearing connection between the floating vessel and the risers. The buoyancy cans need to provide enough buoyancy to support the required top tension in the risers, the weight of the cans and stem, and the weight of the surface wellhead. One disadvantage with the air cans is that they are formed of metal, and thus add considerable weight themselves. Thus, the metal air cans must support the weight of the risers and themselves. In addition, the air cans are often built to pressure vessel specifications, and are thus costly and time consuming to manufacture.

In addition, as risers have become longer by going deeper, their weight has increased substantially. One solution to this problem has been to simply add additional air cans to the riser so that several air cans are attached in series. It will be appreciated that the diameter of the air cans is limited to the width of the well bays within the platform structure. Thus, when additional buoyancy has been required, the natural solution has been to extend the length or number of the air cans. One disadvantage with more and/or larger air cans is that the additional length air cans adds more and more weight which also must be supported by the air cans, decreasing the air can's ability to support the risers. Another disadvantage of simply stringing more air cans together is that their weight and length make it very expensive, technically difficult and dangerous to install the buoyancy cans into the vessel's centerwell. Some of these steel air cans are up to 400 feet long and weigh 160,000 lbs. Another disadvantage with merely stringing a number air cans is that long strings of air cans may present structural problems themselves. For example, a number of air cans pushing upwards on one another, or on a stem pipe, may cause the cans or stem pipe to buckle.

In addition to providing buoyancy, the air cans also are subjected to loads or forces between the riser and the vessel. For example, the air cans are also subjected to side loads and bending loads caused by hydrodynamic loads acting on the buoyancy cans during vessel movement. Thus, air cans usually must be designed to address both buoyancy and dynamic loading.

SUMMARY OF THE INVENTION

It has been recognized that it would be advantageous to develop a buoyancy system for offshore oil platforms that decouples, or separately addresses, the simultaneous design challenges of 1) resolving loads and forces imposed on the buoyancy system, and 2) providing the required buoyancy to properly tension the riser system.

The invention provides a buoyancy system with an internal beam device to buoy one or more risers of an offshore oil platform. The risers can be operatively coupled to the oil platform and can extend from the oil platform to a seabed, and can conduct oil or gas therethrough. The buoyancy system can be movably disposed in the oil platform, and can apply a buoyancy force to the risers to support the risers.

The buoyancy system advantageously can include an elongated internal beam configured to withstand side and bending loads transferred between the oil platform and the buoyancy system. In one aspect, the internal beam can extend substantially along the length of the buoyancy system. The internal beam includes an elongated stem with an axially disposed bore to receive the risers therethrough. In addition, the internal beam includes a plurality of webs extending substantially along a length of the elongated stem. The webs have inner edges attached to the stem, and extending radially outward therefrom to opposite outer edges. Furthermore, the internal beam includes a plurality of transverse flanges attached to the outer edges of the webs. Together, the stem, the webs, and the transverse flanges form a structural beam to withstand loads between the buoyancy system and the oil platform.

In addition, the buoyancy system can include one or more enclosures or compartments coupled to the stem. The enclosures contain a buoyant material to produce a buoyancy force when submerged.

In accordance with a more detailed aspect of the present invention, the buoyancy system can include a rib and groove interface between the compartments and the internal beam. A plurality of ribs can be formed along the stem, while a plurality of mating grooves can be formed in the compartments. The ribs and the grooves can intermesh so that a buoyancy force of the compartment is transferred to the stem through the ribs.

In accordance with another more detailed aspect of the present invention, each of the plurality of compartments can include a one-piece, continuous liner encapsulated in a fiber composite matrix laminate. The liner can be formed by rotational molding.

Additional features and advantages of the invention will be apparent from the detailed description which follows, taken in conjunction with the accompanying drawings, which together illustrate, by way of example, features of the invention.

DETAILED DESCRIPTION

Figure 1:
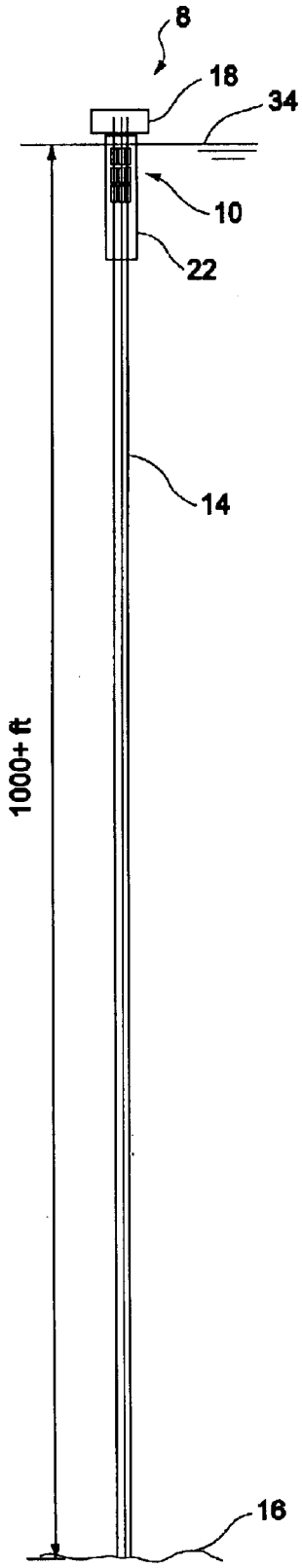
FIGS. 1 and 2 are schematic side views a floating oil platform utilizing a buoyancy system in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
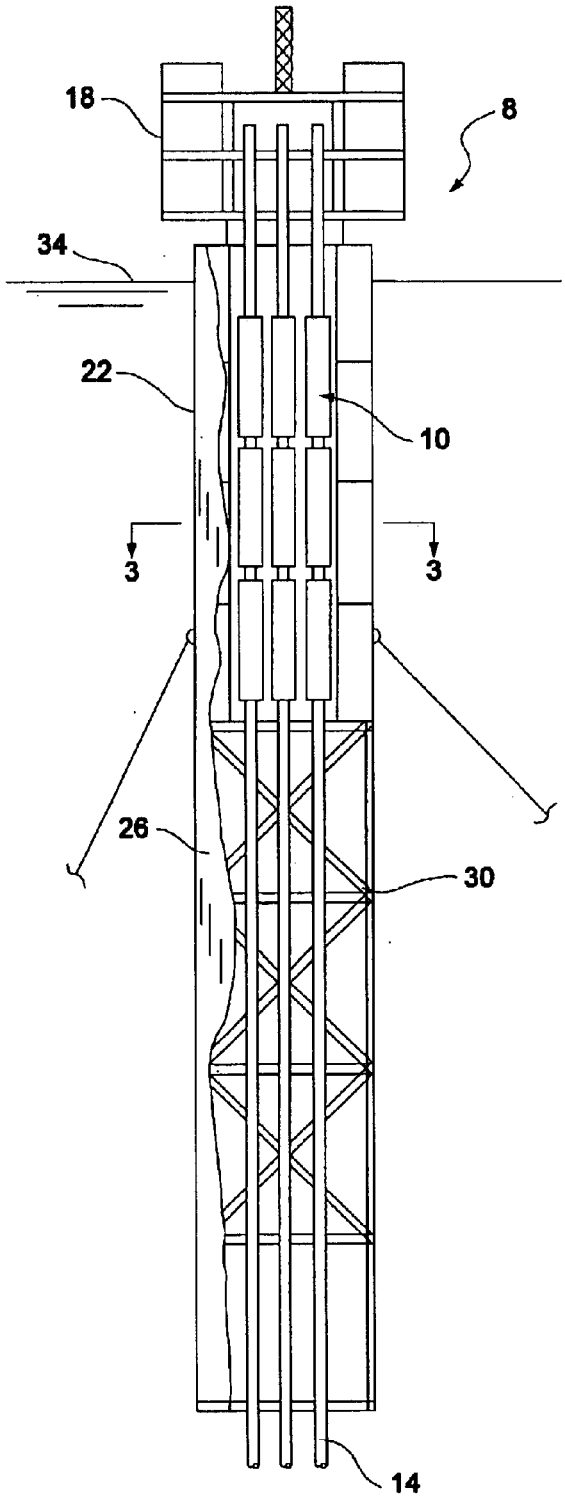
Figure 3:
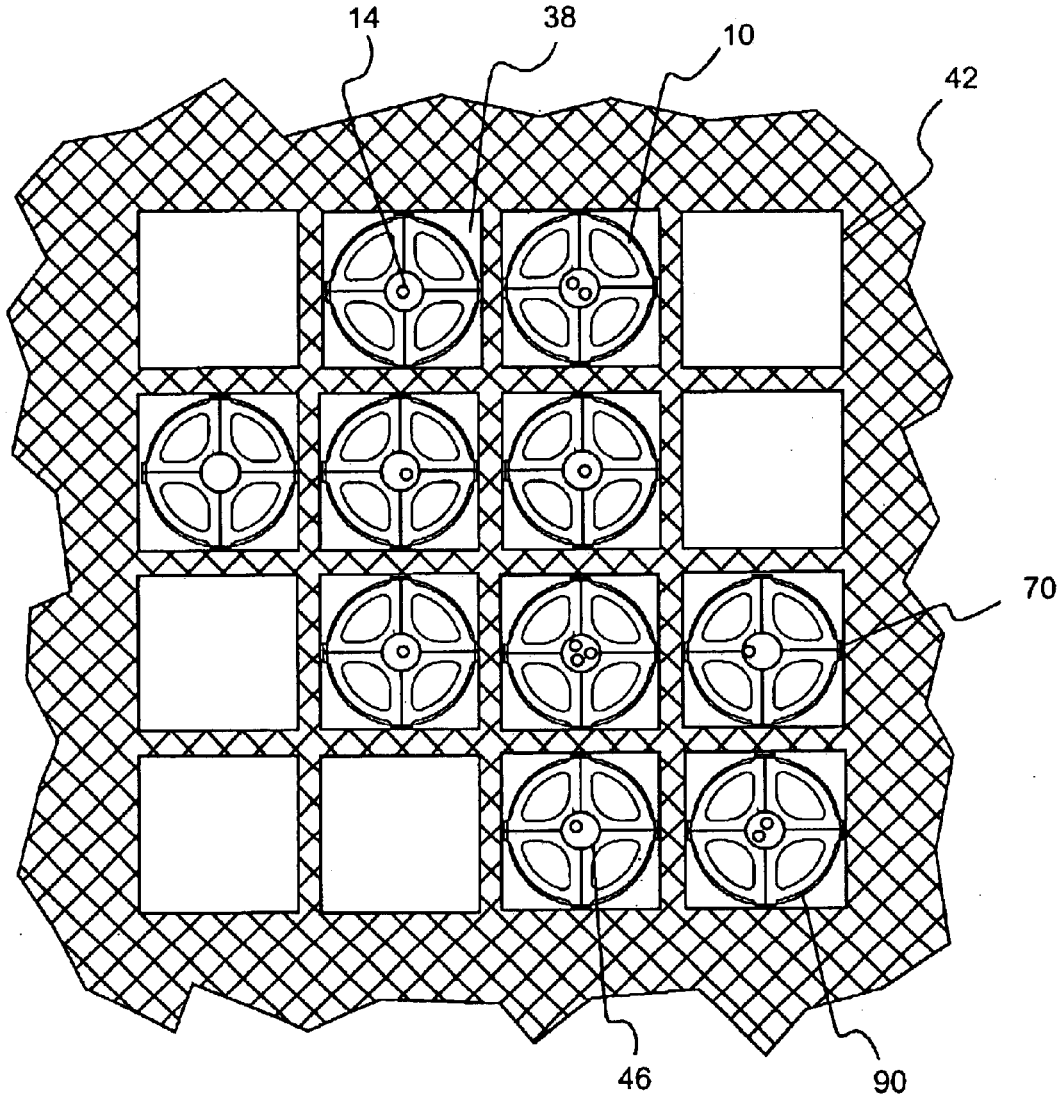
FIG. 3 is a partial cross-sectional top view of the oil platform with the buoyancy system of FIG. 1, taken along line 3—3 of FIG. 2.

As illustrated in FIGS. 1–3, an offshore oil platform 8 or system is shown with a buoyancy system 10 including an internal beam 12 (FIG. 4) in accordance with the present invention. The buoyancy system 10 provides buoyancy to, and top tensions, one or more risers 14, or a riser system, that is operatively coupled to, and extends from, the platform 8 to the seabed or ocean floor 16. As described below, the buoyancy system 10 advantageously decouples, or separately addresses, the simultaneous design challenges of 1) resolving loads and forces imposed on the buoyancy system 10, and 2) providing the required buoyancy to properly buoy and top-tension the risers 14. Separately addressing the imposed loading and the buoyancy requirements advantageously allows the buoyancy of the buoyancy system to be increased so that the length of the risers can be increased to reach more distant oil reserves.

The platform 8 can be a deep-water, floating oil platform, as shown. Deep water oil drilling and production is one example of a field that may benefit from use of such a buoyancy system 10. Such buoyant platforms can be located above and below the surface, and can be utilized in drilling and/or production of fuels, such as oil and gas, typically located off-shore in the ocean at locations corresponding to depths of overseveral hundred or thousand feet. In addition, such buoyant platforms can include classical, truss, tube and concrete spar-type platforms or Deep Draft Caisson Vessels, etc. Thus, the fuel, oil or gas reserves are located below the ocean floor at depths of over several hundred or thousand feet of water.

In addition, the platform 8 can be a truss-type, floating platform, as shown, and can have above-water, or topside, structure 18, and below-water, or submerged, structure 22. The above-water structure 18 can include several decks or levels which support operations such as drilling, production, etc., and thus may include associated equipment, such as a work over or drilling rig, production equipment, personnel support, etc. The submerged structure 22 can include a hull 26, which may be a full cylinder form. The hull 26 may include bulkheads, decks or levels, fixed and variable seawater ballasts, tanks, etc. The fuel, oil or gas may be stored in tanks in the hull. The platform 8, or hull 26, also has mooring fairleads to which mooring lines, such as chains or wires, are coupled to secure the platform or hull to an anchor in the sea floor.

The hull 26 or submerged structure 22 also can include a truss or structure 30. The hull 26 and/or truss 30 may extend several hundred feet below a surface 34 of the water, such as 650 feet deep. A centerwell or moonpool 38 (FIG. 3) can be located in the hull 26 or truss structure 30. The buoyancy system 10 can be movably located in the hull 26, truss 30, and/or centerwell 38 and movable with respect to one another. The centerwell 38 is typically flooded and contains compartments 42 (FIG. 3) or sections for separating the risers and the buoyancy system 10. The hull 26 provides buoyancy for the platform 8, while the centerwell 38 protects the risers and buoyancy system 10.

It is of course understood that the truss-type, floating platform 8 depicted in FIGS. 1 and 2 is merely exemplary of the types of floating platforms that may be utilized. For example, other spar-type platforms may be used, such as classic spars, tube or concrete spars. In addition, it is understood that the platform can float partially or wholly submerged.

The buoyancy system 10 supports the deep water risers 14 which extend from the floating platform 8, near the water surface 34, to the bottom of the body of water, or ocean floor 16. The risers 14 are typically steel pipes or tubes with a hollow interior for conveying the fuel, oil or gas from the reserve, to the floating platform 8. Such pipes or tubes can extend over several hundred or thousand feet between the reserve and the floating platform 8, and can include production risers, drilling risers, and export/import risers. The deep-water risers 14 can be coupled to the platform 8 by a thrust plate located on the platform 8 such that the risers 14 are suspended from the thrust plate, as is known in the art. In addition, the buoyancy system 10 can be coupled to the thrust plate such that the buoyancy system 10 supports the thrust plate, and thus the risers 14.

The buoyancy system 10 can be utilized to access deep-water oil and gas reserves with deep-water risers 14 which extend to extreme depths, such as over 1000 feet, over 3000 feet, and even over 5000 feet. It will be appreciated that thousand feet lengths of steel pipe are exceptionally heavy, or have substantial weight. It also will be appreciated that steel pipe is thick or dense (i.e. approximately 0.283 lbs/in$^3$), and thus experiences relatively little change in weight when submerged in water, or seawater (i.e. approximately 0.037 lbs/in$^3$). Thus, for example, steel only experiences approximately a 13% decrease in weight when submerged. Therefore, thousands of feet of riser, or steel pipe, is essentially as heavy, even when submerged.

The buoyancy system 10 can be submerged and can include a buoyant material, such as air, to produce a buoyancy force to buoy, support or tension the risers 14. The buoyancy system 10 can be coupled to one or more risers 14 via the thrust plate, or the like. Therefore, the risers 14 exert a downward force due to their weight on the thrust plate, while the buoyancy system exerts an upward force on the thrust plate. The upward force exerted by the buoyancy system 10 can be equal to or greater than the downward force due to the weight of the risers 14, so that the risers 14 do not pull on the platform 8 or rigging.

As stated above, the thousands of feet of risers 14 exert a substantial downward force on the buoyancy system 10. It will be appreciated that the deeper the targeted reserve, or as drilling and/or production moves from hundreds of feet to several thousands of feet, the risers 14 become exceedingly more heavy, and more and more buoyancy force will be required to support the risers 14. It has been recognized that it would be advantageous to optimize the systems and processes for accessing deep reserves, to reduce the weight of the risers and platforms, and increase the buoyant force. In addition, it will be appreciated that the risers 14 move with respect to the platform 8 and centerwell 38, and that such movement between the buoyancy system and centerwell 38 or platform 8 can exert lateral forces and/or bending forces on the buoyancy system. It will also be appreciated that as the vessel pitches and roll about the keel that it drags the risers and buoyancy cans through the water trapped within the centerwell, thereby imposing hydrodynamic loads on the buoyancy cans. Thus, it has been recognized that it would be advantageous to increase the structural integrity of the buoyancy system, while at the same time reducing weight and increasing buoyancy. In addition, it has been recognized that it would be advantageous to decouple, or separately address, the simultaneous design challenges of 1) resolving loads and forces imposed on the buoyancy system 10, and 2) providing the required buoyancy to properly buoy and top-tension the riser system 14.

As stated above, the buoyancy system 10 advantageously includes an elongated internal beam 12 (FIG. 4) to withstand loads between the oil platform 8 or centerwell 38 and the buoyancy system 10. The internal beam 12 can extend substantially along the buoyancy system, or along a substantial length of the buoyancy system, to withstand loads imposed along the length of the buoyancy system. The thickness of each member of this beam assembly can be sized differently depending on the side or bending loads experienced in that particular location. Referring to FIGS. 4–8, the buoyancy system 10 or internal beam 12 can include an elongated stem 46 with an axially disposed bore 50 to receive the risers 14 therethrough. Thus, the stem 46 can be tubular.

Figure 8:
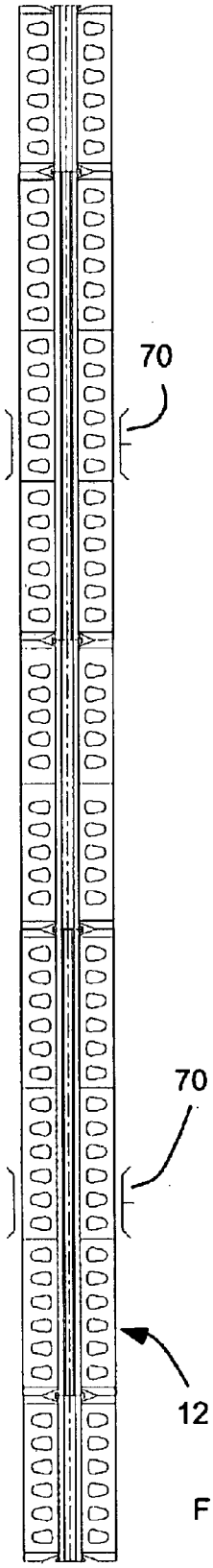
FIG. 8 is a side view of an internal beam of the buoyancy system in accordance with the present invention.

A plurality of webs 54 extend substantially along a length of the elongated stem 46. The webs 54 have inner edges 58 attached to the stem 46, and extend outward radially therefrom to opposite outer edges 62. A plurality of transverse flanges 66 can be attached to the outer edges 62 of the webs 54. Together, the stem 46, the webs 54 and the flanges 66 form a structural beam to withstand loads between the buoyancy system 10 and the oil platform 8. As the buoyancy system 10 and the internal beam 12 move in the platform 8 or the centerwell 38, and as the risers 14 and the platform 8 pull on one another, forces, loads and/or torques are applied between the platform 8 and the buoyancy system 10. The forces, loads and/or torques between the platform 8 and the buoyancy system 10 or the risers 14 can act on the internal beam 12. The beam configuration allows the buoyancy system to withstand the imposed forces. The flanges 66 also can bear against or contact the platform 8, centerwell 38, or other structure associated with the centerwell 38, such as bearing surfaces, glide plates, or rollers, indicated at 70 (FIG. 8).

Figure 6:
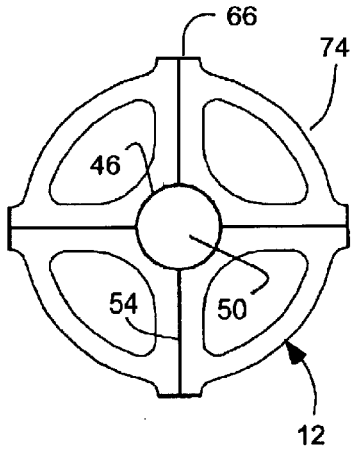
FIG. 6 is an end view of the internal beam of FIG. 4.
Figure 7:
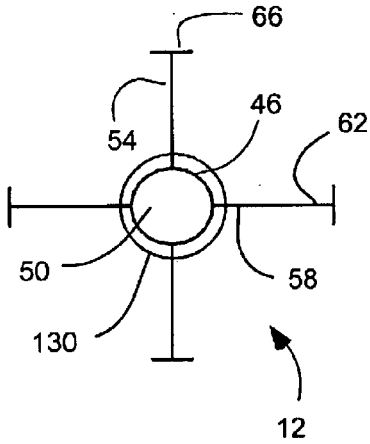
FIG. 7 is a cross sectional end view of the internal beam of FIG. 4.

Referring to FIGS. 6 and 7, in one aspect, the plurality of webs 54 can include four webs oriented in two different orientations. For example, the two different orientations can be perpendicular, so that the four webs are located 90 degrees apart to form a cross-section with an "X"-shape or "+"-shape. Thus, the webs 54 can be disposed in pairs, with each web of the pair being disposed on opposite sides of the stem 46. A second pair of webs can be oriented perpendicularly to a first pair of webs. The internal beam 12 maybe conceptualized as a pair of intersecting I-beams, with a tube or stem at the intersection to accommodate the risers. The intersecting or perpendicular configuration allows the internal beam to withstand forces imposed from multiple directions. The internal beam 12 has external structure, such as flanges 66, disposed at a perimeter of the buoyancy system 10 to contact and be acted upon by the platform 8, and internal structure, such as the webs 54 and stem 46, to accommodate the imposed loads. The flanges 66 also act as a foundation for wear resistant strips that rub directly against the buoyancy system guides 70. In addition, the cross-sectional shape of the internal beam 12 allows the beam or webs to extend across the compartments 42 of the centerwell 38 (FIG. 3) in multiple directions. The flanges 66 can bear against buoyancy system guides 70 located in the corners of each compartment 42 or centerwell 38 as the buoyancy system 10 moves in the centerwell, and as forces or loads are transferred between the buoyancy system 10 and platform 8.

Referring again to FIGS. 4–7, the buoyancy system 10 or internal beam 12 can include one or more bulkheads 74. The bulkheads 74 can be disposed around the stem 46 and oriented transverse to both the stem 46 and the plurality of webs 54. Portions of the bulkheads 74 can extend between adjacent webs. The bulkheads 74 can support the webs 46 with respect to the stems 46, and the flanges 66 with respect to the webs 54. A plurality of bulkheads 74 can be disposed along the length of the stem 46 or buoyancy system 10. An array of apertures 78 can be formed in the webs 54, and can extend along the length of the webs. The apertures 78 remove material from the webs, thus reducing their weight. The interior of the stem can have a polymer liner, such as a coal tar epoxy, or a dissimilar metallic coating such as thermal sprayed aluminum to inhibit corrosion and oxidation. The outer surfaces of the stem, webs, or flanges can be coated with a dissimilar metallic coating, such as a thermal sprayed aluminum.

Figure 5:
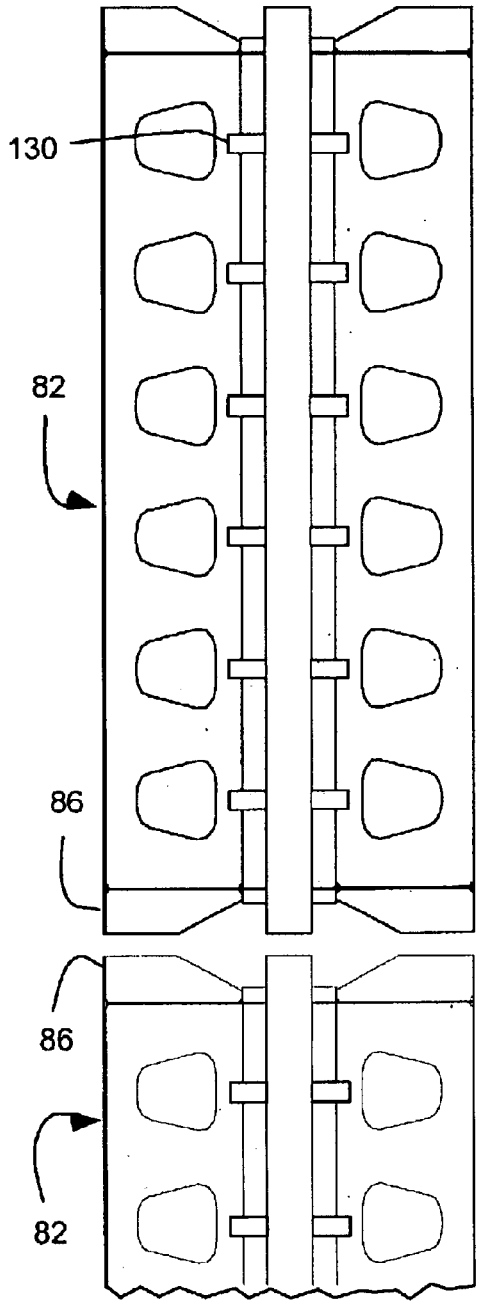
FIG. 5 is a partial side view of two modular internal beams of the buoyancy system in accordance with an embodiment of the present invention.

The stem 46, the webs 54 and the transverse flanges 66 can be provided in a plurality of modular sections 82 or buoyancy modules (FIG. 5). The modular sections 82 can be joined end-to-end in series to form the length of the buoyancy system 10. Portions 86 of the modular sections 82 (FIG. 5), or portions of the webs or flanges, can extend from the modular sections, and can be coupled to adjacent modular sections. For example, bolts can extend through bores in the portions 86 to couple adjacent portions and adjacent modular sections together. Thus, a plurality of modular sections 82 or buoyancy modules can be coupled together to form the length of the buoyancy system 10, or the elongated internal beam 12, as shown in FIG. 8. The size and weight of the modular sections 82 can be limited to lengths and weights easily handled by standard equipment or deck cranes on the platform, for example less than 60 feet and less than 70,000 lbs, while the internal beam 12 formed by the modular sections 82 can extend much longer, for example 120 –300 feet or longer.

The internal beam 12 can be formed of metal. For example, the stem 46 can be a metal tube, while the webs 54 can be metal plates welded to the stem 46. Similarly, the flanges 66 can be metal plates welded to the webs 54. The bulkheads 74 also can be metal welded to the webs.

Referring to FIGS. 9–15, the buoyancy system 10 can include one or more buoyant enclosures or compartments 90 coupled to the internal beam 12, or to the stem 46. The buoyant compartments 90 can contain a buoyant material 94, such as air. It is of course understood that the buoyant material can include other buoyant materials, such as foam. The buoyant material and buoyant compartments produce a buoyancy force when submerged. The buoyancy force produced by the buoyant compartments is transferred to the stem.

The buoyancy system 10 can include four buoyancy compartments 90 circumscribing the stem 46 and disposed in the spaces between the webs 54. The compartments 90 can be sized and shaped to extend between the adjacent webs 54, and between the bulkheads 74. Thus, the compartments 90 can substantially fill the buoyancy system 10, or spaces between the webs, to maximize the buoyancy force. The buoyant compartments 90 can include opposite side walls 100 and 102 disposable adjacent the webs 54, an inner wall 106 disposable adjacent the stem 46, and an outer wall 110 opposite the inner wall 106. The side walls 100 and 102 can be oriented perpendicular to one another to match the perpendicular orientation of the webs 54. The inner wall 106 can be arcuate to match a circular shape of the stem 46. Similarly, the outer wall 110 can be arcuate to resist contact with the centerwell 38 or compartments 42, and to provide stiffness to the outer wall. In addition, the compartments 90 can include upper and lower, or top and bottom, walls 114 and 116. Ribs can be integrally formed in the top wall 114 to provide rigidity and structural integrity. Together, the walls form the enclosure or compartment.

Figure 16:
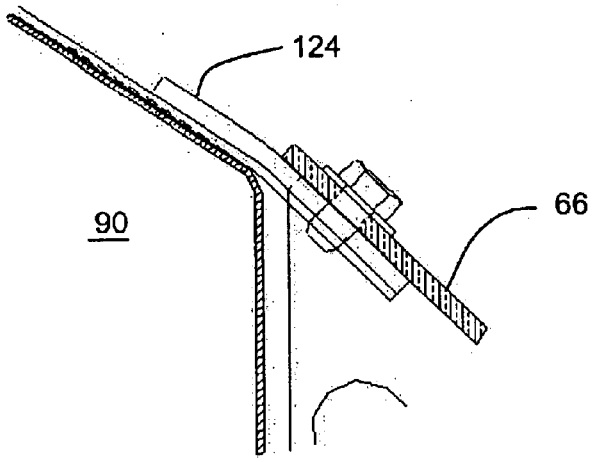
FIG. 16 is a detail view of an attachment of a strap to retain the buoyancy compartment to the internal beam of the buoyancy system in accordance with an embodiment of the present invention.

A plurality of straps can be used to retain the enclosures or compartments on the internal beam. A plurality of arcuate indentations 120 can be formed in the outer wall 110 of the enclosures 90. A plurality of retention straps 124 (FIG. 16) can be attached to the internal beam 12 and can engage the indentations 120 to secure the compartments 90 to the internal beam. The indentations 120 retain the straps 124 with respect the compartments 90, and resist slipping between the two. The straps 124 and indentations 120 are one example of a means for securing the compartments to the internal beam. The straps 124 can be secured to the flanges 66, such as with bolts or plug welded joints, as shown in FIG. 16. Thus, the straps 124 can extend between adjacent flanges to hold the compartments 90 against the stem 46.

Figure 4:
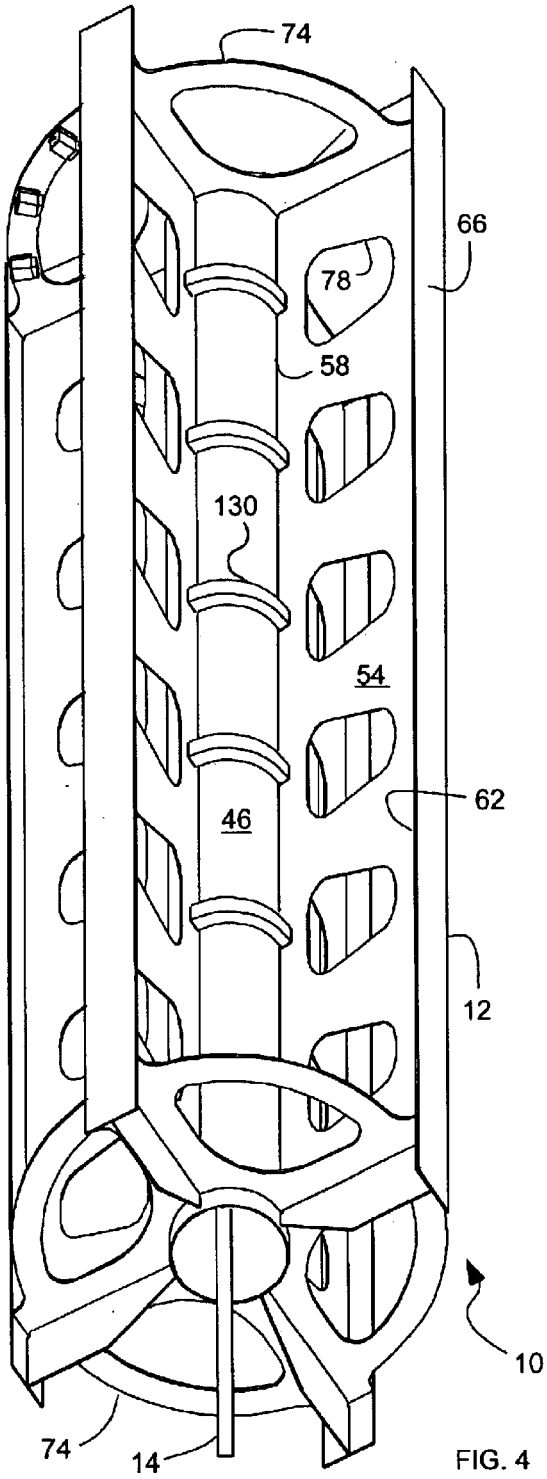
FIG. 4 is a partial perspective view of an internal beam of the buoyancy system in accordance with an embodiment of the present invention.
Figure 20:
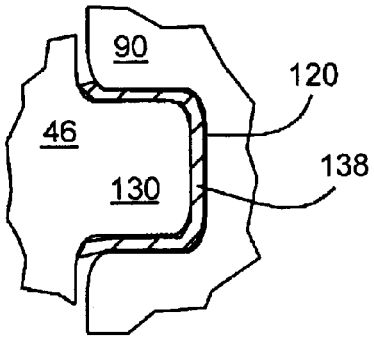
FIG. 20 is a detail view of a mating rib and groove connection between the buoyancy compartment and internal beam in accordance with an embodiment of the present invention.

In addition, a mating rib and groove system can be used to longitudinally secure the enclosures or compartments to the stem, and to transmit buoyant force from he compartments directly to the stem. A plurality of ribs 130 can be formed along the stem 46, as shown in FIGS. 4 and 5. A plurality of mating grooves 134 can be formed in the compartments 90. The ribs 130 and the grooves 134 can intermesh so that the buoyancy force of the compartments 90 is transferred to the stem 46 through the ribs 130. For example, the ribs and grooves can be formed approximately every three feet. Referring to FIG. 20, it will be appreciated that gaps may be formed between the ribs and the grooves that reduce the efficiency of the force transfer, and/or create stress concentrations. Shims 138 can be disposed in the gaps between the ribs and the grooves to reduce stress concentrations. For example, the shims can be liquid shims, formed of thermoset composite, RTV rubber or microballon cement.

Referring again to FIGS. 11–15 and 19*a*, each of the compartments 90 can be formed as a one-piece, continuous liner 144. Thus, the walls of the compartment can be formed as a single, integral piece. In one aspect, the compartments 90 or liner can be formed of a thermoplastic material. Thus, the compartments 90 can be lighter-weight than traditional steel air cans. The compartment 90 or liner can be formed in a rotomold process to form the one-piece, continuous liner. In addition, the compartment or liner can be encapsulated in a fiber composite matrix laminate 148. The fiber composite can form an outer layer that acts to limit radial deflection of the inner and outer walls 106 and 110, limit axial deflection in the top wall 114, and can act as thermal protection against welding spatter, hot grinding particles, etc.

Furthermore, the thermoplastic material and/or fiber composite matrix laminate can include a pigment to color the material to facilitate inspection. For example, the pigment can be a yellow, light blue, orange, mauve, etc. Such colors allow for inspection by ROV video cameras. In addition, an outer layer of the compartments 90 can be provided with a traction layer to allow for traction while walking on the compartments. It will be appreciated that the material forming the compartments can be slick or slippery. To prevent slipping when walking on the compartments, the traction layer can be integrally molded.

As described above, the compartments 90 can be filled with a buoyant material, such as pressurized air, to be buoyant. The side walls 100 and 102 of the compartments 90 can be flexible, or can be formed of a flexible material. Thus, as the compartments 90 are pressurized the side walls press or bear against the webs 54 and apply a lateral load to the webs. The pressure against the webs 54 can help stabilize and support the webs.

The buoyancy compartments 90 are one example of a buoyancy means for containing a buoyant material and securing the buoyant material to the stem. It is of course understood that other buoyancy means are possible, including compartments of different shapes, numbers, materials, etc.

Figure 9:
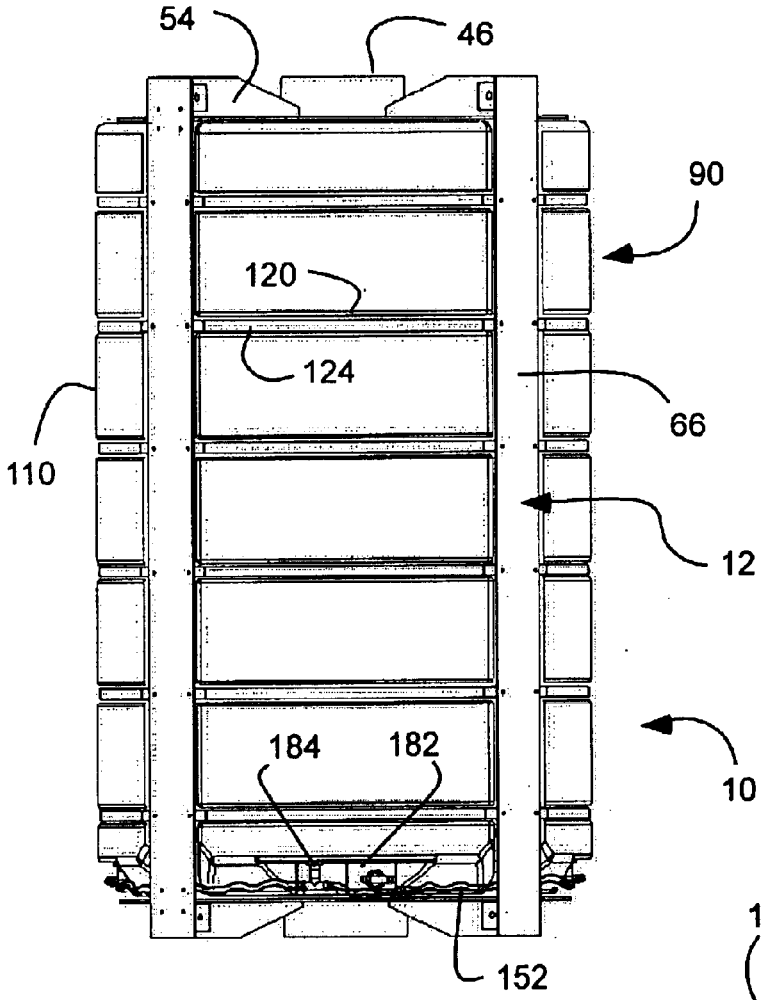
FIG. 9 is a partial side view of the buoyancy system in accordance with the present invention.
Figure 10:
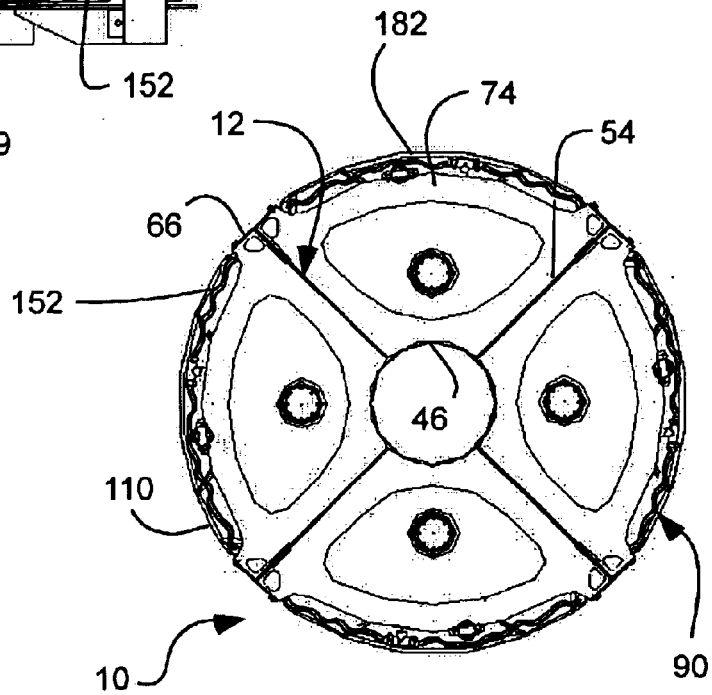
FIG. 10 is a bottom end view of the buoyancy system of FIG. 9.
Figure 11:
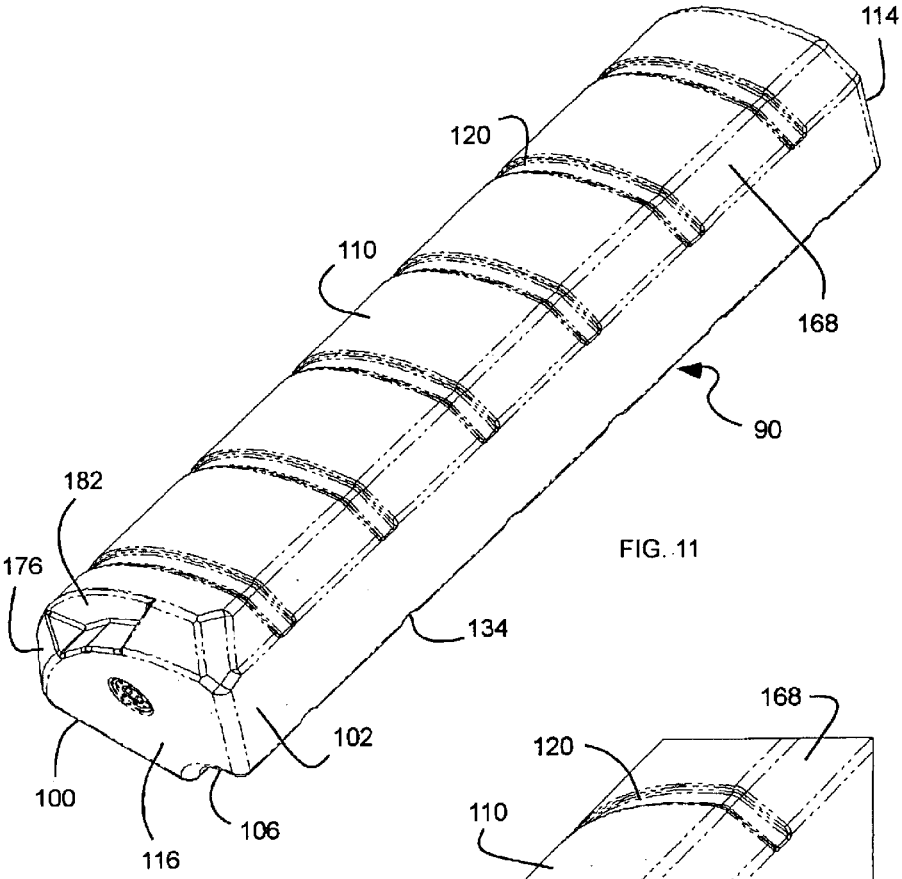
FIG. 11 is a bottom perspective view of a buoyancy compartment of the buoyancy system in accordance with an embodiment of the present invention.
Figure 12:
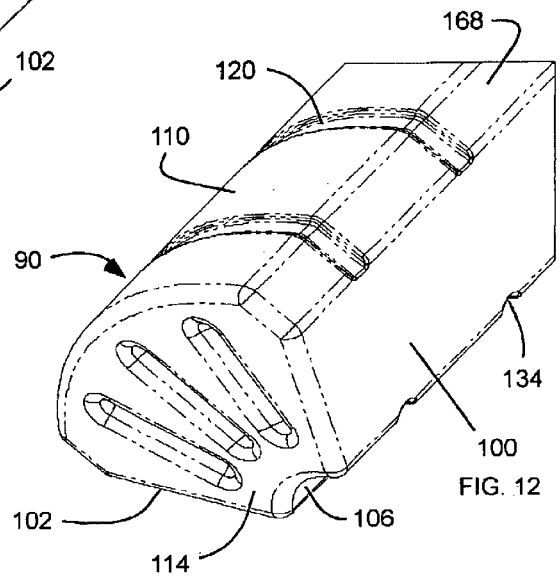
FIG. 12 is partial top perspective view of the buoyancy compartment of FIG. 11.
Figure 15:
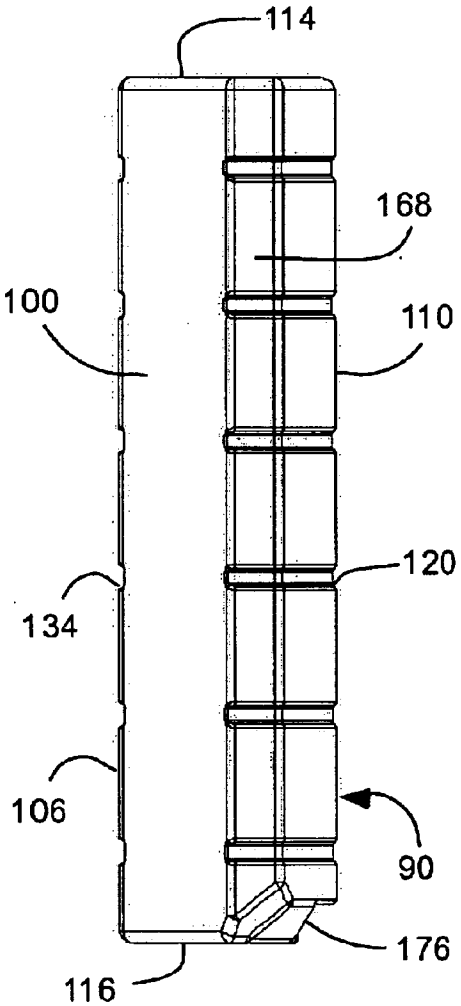
FIG. 15 is a side view of the buoyancy compartment of FIG. 11.
Figure 14:
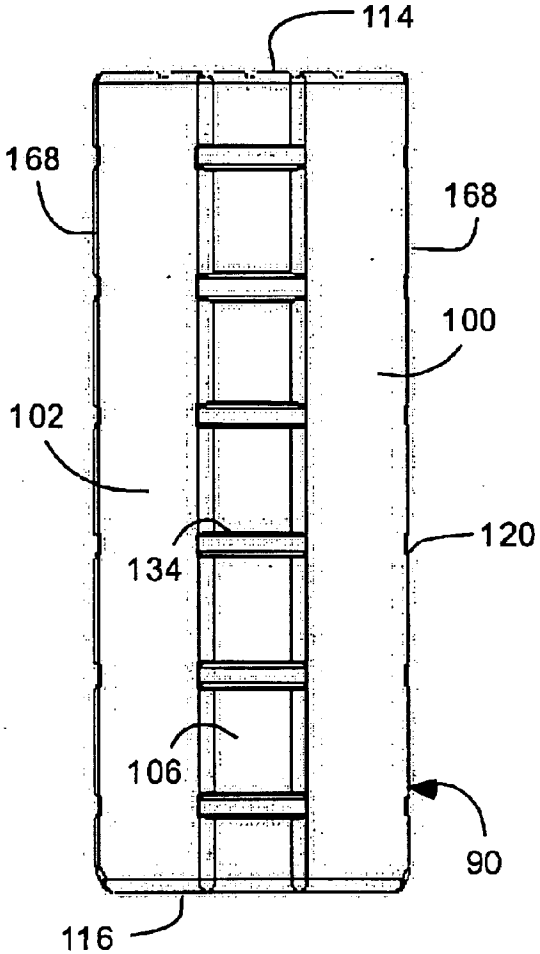
FIG. 14 is an inner side view of the buoyancy compartment of FIG. 11.
Figure 13:
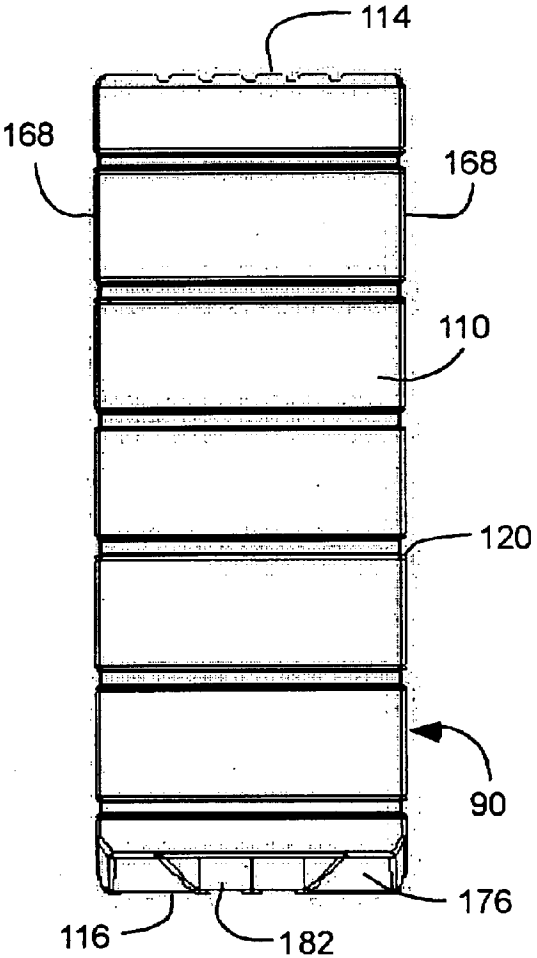
FIG. 13 is an outer side view of the buoyancy compartment of FIG. 11.

As described above, the compartments 90 can circumscribe the stem 46 between the webs 54 to define adjacent lateral compartments. In one aspect, the buoyancy of the adjacent lateral compartments is the same so that there are equal buoyancy forces around the stem. The adjacent lateral compartments can be operatively interconnected, such as by air lines 152 (FIGS. 9 and 10).

The platform 8 can include an air management apparatus to provide and control air to the compartments 90, and thus to control the buoyancy. The air management apparatus can include a pressurized air source and air lines extending from the air source to the compartments. The air source can be a compressor positioned at the platform. The air management apparatus or air source can be used to increase the air in the compartments. For example, air can be introduced into the compartments to drive water out, increasing buoyancy. Alternately, air can be allowed to escape from the compartments, allowing water in, and decreasing buoyancy.

Figure 17:
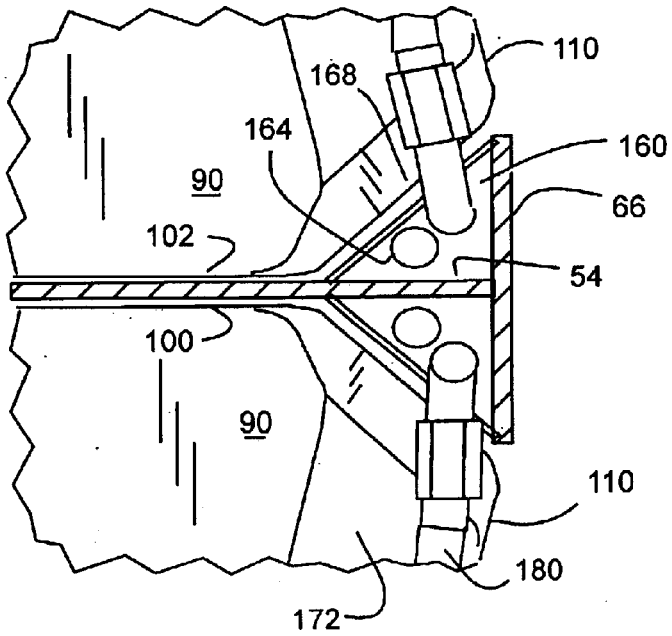
FIG. 17 is a detail view of a channel for air lines to the buoyancy compartment of the buoyancy system in accordance with an embodiment of the present invention.
Figure 18:
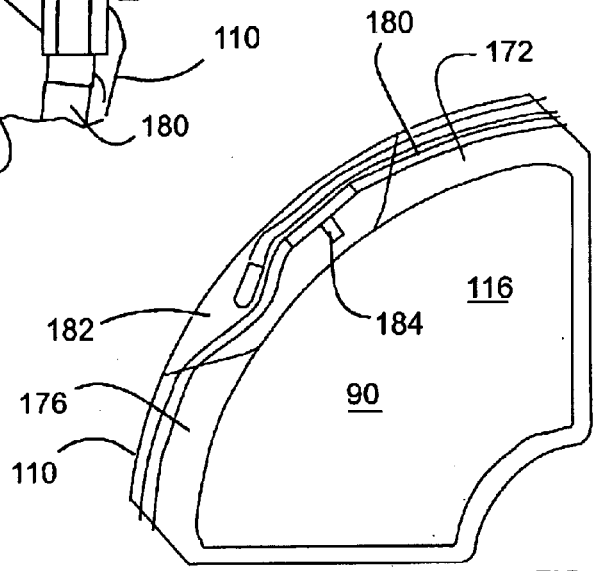
FIG. 18 is a detail view of a channel for air lines to the buoyancy compartment of the buoyancy system in accordance with an embodiment of the present invention.

Referring to FIGS. 17 and 18, the buoyancy system 10 can include channels to accommodate the air lines extending longitudinally along, and laterally around, the buoyancy system to deliver air. For example, a channel 160 can extend longitudinally along the buoyancy system. The channel 160 can be formed between the compartment 90, an adjacent web 54, and an adjacent flange 66. The air line 164 can extend longitudinally through the channel 160. The compartment 90 can include an edge wall 168 between the side wall 100 or 102 and the outer wall 110. The edge wall 168 can form an oblique angle with respect to the web 54. Thus, the channel 160 can be formed between the edge wall 168, the web 54 and the flange 66.

In addition, a channel or indentation 172 can extend laterally or circumferentially around the buoyancy system. The channel 172 can be formed between the bottom wall 116, the outer wall 110. Similarly, an edge wall 176 can be formed between the bottom wall 116 and the outer wall 110. The edge wall 176 can form an oblique angle with respect to the flange 66 or bulkhead 74. Thus, the channel or indentation 172 can be formed between the edge wall 176 and a perimeter of the buoyancy system. The air line 180 can extend laterally or circumferentially through the channel or indentation 172. Furthermore, a pocket 182 can be formed in the bottom of the compartments 90 to facilitate fittings 184 for the air system. The pockets 182 allow the fittings 184 to be maintained within a perimeter of the buoyancy system.

Figure 19A:
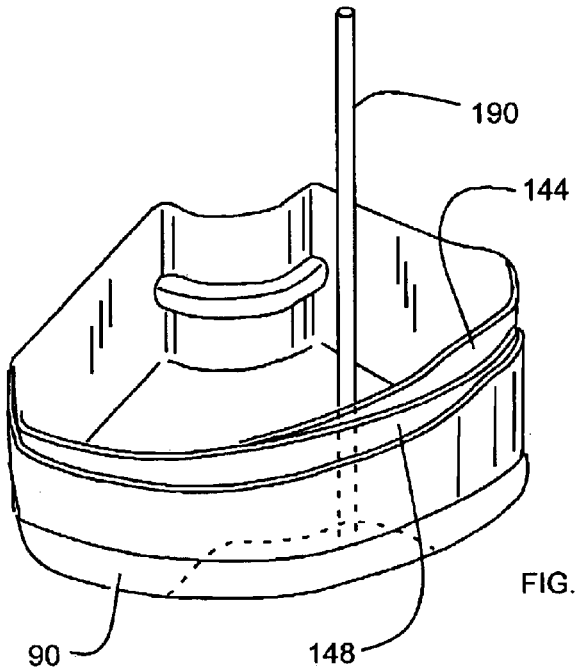
FIG. 19*a* is a partial perspective view of the buoyancy compartment of FIG. 11.
Figure 19B:
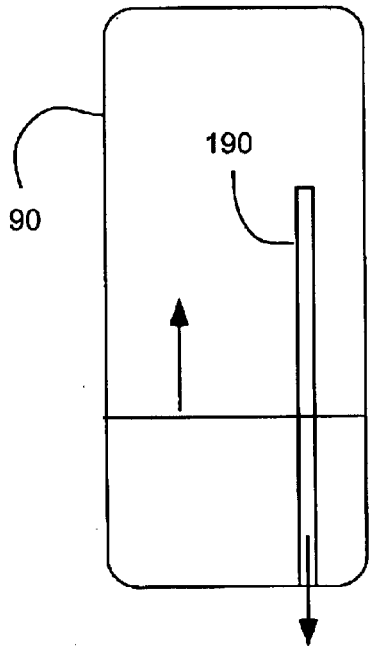
FIGS. 19*b* and 19*c* are schematic views of the buoyancy compartment of FIG. 11.
Figure 19C:
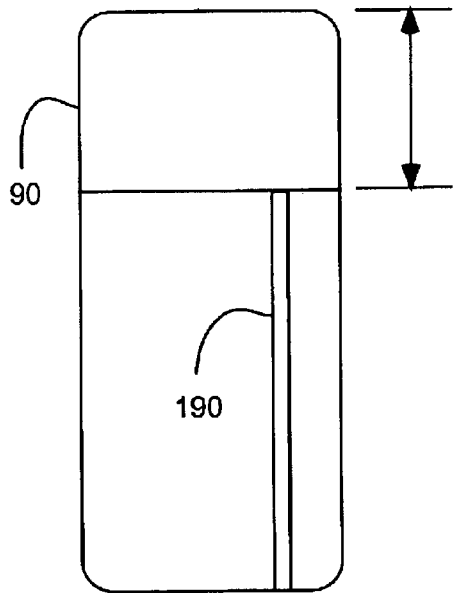

As described above, the air management system can fill the compartments with air, or pressurize the compartments. Alternatively, the air can be released from the compartments to decrease the buoyancy. Thus, water can be allowed into the compartments to displace the air. It can be desirable to maintain a minimum amount or volume of air in the compartments. Thus, referring to FIGS. 19*a*–*c*, an air outlet pipe 190 can be disposed in each of the compartments 90, and can extend from a bottom of the compartments to an intermediate point along a length of the compartments. A minimum space can remain between an upper end of the outlet pipe 190 and a top of the compartment in which the minimum amount of air is disposed. It will be appreciated that as water displaces the air in the compartment (FIG. 19*b*), the water level rises in the compartment until it reaches the upper end of the outlet pipe (FIG. 19*c*), at which point no more air can be removed through the outlet pipe. Thus, a minimum amount of air remains in the compartment, providing a minimum amount of buoyancy.

As described above, the internal beam 12 can be subjected to variable loads and forces along the length. Thus, the internal beam 12 can be configured to withstand the variable loads and forces. In particular, the webs and/or the flanges can be configured for the variable loads and forces, such as having a thickness that varies along the length of the buoyancy system. For example, certain sections can be thicker to withstand larger loads and forces, while other sections can be thinner to withstand lesser loads and forces.

Figure 21:
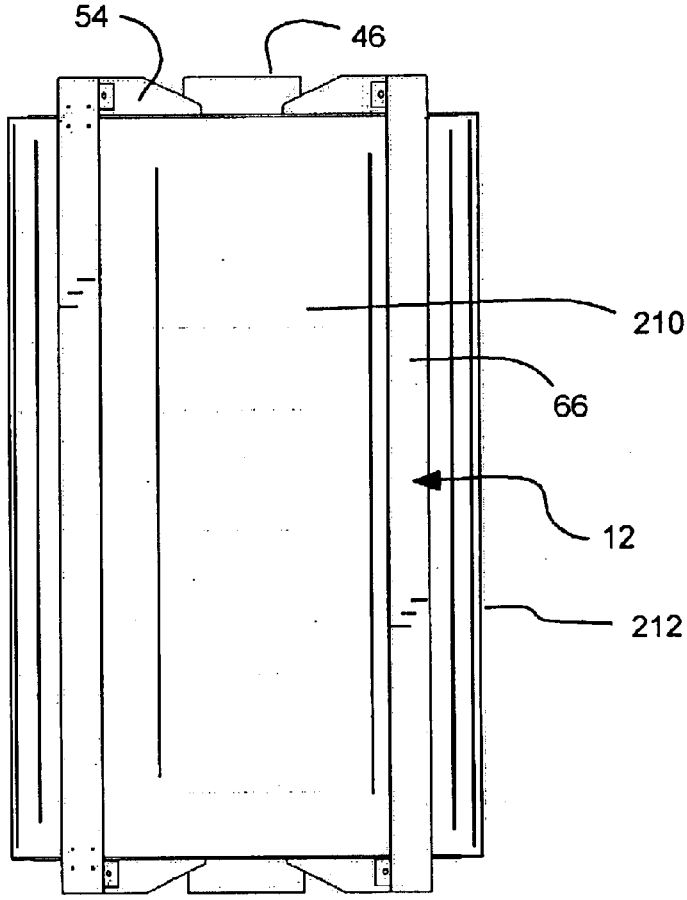
FIG. 21 is a side view of another buoyancy system in accordance with an embodiment of the present invention.

Referring to FIG. 21, the buoyancy system can include another buoyant enclosure or compartment. The buoyant enclosure or compartment can be formed by one or more panels 210 extending around the buoyancy system, or around the internal beam. The panels 210 can extend between the flanges 66. The panels 210 can form a shell 212 that extends circumferentially around the internal beam, or the stem and webs. For example, steel quarter panels 210 can be welded to the flanges 66 to form a steel skin or shell extending around a perimeter of the buoyancy system. The buoyant force can push upward against the bulkheads which transfer the force to the steam. For example, the bulkheads can be located along the stem at 20–24 feet intervals.

From the above description it will be appreciated that the present invention provides a simple, minimum weight, load bearing structure, i.e. the internal beam 12, and packages the required buoyancy around it. In addition, the buoyant forces are transferred to the stem.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. An internal beam device configured for a buoyancy system for a riser extending from an ocean floor to an oil platform with a stem receiving at least a portion of the riser and coupled to the riser in a load bearing relationship, the internal beam device comprising:

a plurality of modular sections joined end-to-end in series, each modular section including four webs and a portion of the stem, the webs having inner edges attached to the stem at ninety degree intervals around the stem and extending radially outwardly therefrom to opposite outer edges, the webs of each section being configured to support buoyancy means between the webs and withstand loads between the internal beam device and the oil platform during use, each modular section further including two spaced-apart bulkheads disposed towards opposite ends of the modular section, the bulkheads extending between adjacent webs and extending substantially between the stem and the outer edges of the webs; and means for coupling adjacent modular sections together in an end-to-end relationship with the webs of adjacent modular sections coupled together to form a length of the internal beam device.

2. A device in accordance with claim 1, wherein each modular section further comprises:

a transverse flange, attached to the outer edge of each of the webs and extending at least between the spaced-apart bulkheads.

3. A buoyancy system configured for a riser extending from an ocean floor to an oil platform, the system comprising:

a plurality of modular sections joined end-to-end in series, each section including:

an elongated, vertical stem having an axially disposed bore configured to receive at least one riser therethrough;

four webs having inner edges attached to the stem at ninety degree intervals around the stem and extending radially outwardly therefrom to opposite outer edges; and two spaced-apart bulkheads disposed towards opposite ends of the modular section, the bulkheads extending between adjacent webs and extending substantially between the stem and the outer edges of the webs;

means for coupling the webs of adjacent modular sections together in an end-to-end relationship to form a length of the buoyancy system;

buoyancy means, supported by each of the modular sections, for containing a buoyant material; and the webs extending along substantially an entire length of the buoyancy means, the webs being configured to withstand loads between the internal beam device and the oil platform during use.

4. A device in accordance with claim 3, wherein each modular section further comprises:

a transverse flange, attached to the outer edge of each of the webs and extending at least between the spaced-apart bulkheads.

5. A device in accordance with claim 3, wherein the buoyancy means includes:

at least one enclosure, coupled to each modular section, and containing a buoyant material configured to produce a buoyancy force.

6. A device in accordance with claim 3, wherein opposite webs of the modular sections have a width extending across compartments of a centerwell of the oil platform.

* * * * *